US006510664B2

(12) United States Patent
Kupczyk

(10) Patent No.: US 6,510,664 B2
(45) Date of Patent: Jan. 28, 2003

(54) MULTI-LAYERED SHINGLE

(76) Inventor: Stephen J. Kupczyk, 38 Pheasant Ridge, Newnan, GA (US) 30265

( * ) Notice: Subject to any disclaimer, the term of this patent is extended or adjusted under 35 U.S.C. 154(b) by 44 days.

(21) Appl. No.: 09/881,419

(22) Filed: Jun. 14, 2001

(65) Prior Publication Data

US 2002/0189189 A1 Dec. 19, 2002

(51) Int. Cl.[7] ..... E04D 1/00

(52) U.S. Cl. ..... 52/528; 52/535; 52/555; 52/748.1

(58) Field of Search ..... 52/518, 528, 535, 52/554, 555, 748.1, DIG. 16, 557

(56) References Cited

U.S. PATENT DOCUMENTS

| | | | | |
|---|---|---|---|---|
| 2,571,057 A | | 10/1951 | Patterson | 108/7 |
| 3,624,975 A | | 12/1971 | Morgan | 52/105 |
| 4,233,100 A | | 11/1980 | Cunningham | 156/260 |
| 4,499,702 A | | 2/1985 | Turner | 52/555 |
| 4,717,614 A | | 1/1988 | Bondoc | 428/143 |
| 4,869,942 A | | 9/1989 | Jennus | 428/77 |
| 5,052,162 A | | 10/1991 | Bush | 52/518 |
| 5,375,387 A | | 12/1994 | Davenport | 52/557 |
| 5,471,801 A | * | 12/1995 | Kupczyk et al. | 52/57 |
| 5,666,776 A | | 9/1997 | Weaver | 52/557 |
| 5,853,858 A | | 12/1998 | Bondoc | 428/195 |
| 5,860,263 A | | 1/1999 | Sieling | 52/518 |
| 6,105,629 A | | 8/2000 | Bourgeaux | 139/455 |
| 6,174,403 B1 | | 1/2001 | Steiner, Jr. | 156/260 |

* cited by examiner

*Primary Examiner*—Carl D. Friedman
*Assistant Examiner*—Naoko Slack
(74) *Attorney, Agent, or Firm*—Bernstein & Associates, P.C.; Jason A. Bernstein

(57) ABSTRACT

An integral, one-piece, multi-layered shingle and method of fabrication from a planar sheet of shingle material, e.g., asphalt. The planar sheet comprises a base portion having first and second, parallel, lateral edges, with plural elongated tabs extending from the first lateral edge. The plural elongated tabs are uniquely different but each features a side edge midportion perpendicular to the first lateral edge. Extending from the second lateral edge are a like plurality of short tabs, where the short tabs are laterally offset from the elongated tabs. In a roof placement mode, the elongated tabs are first folded onto the base portion at a midpoint thereof, then reversely bent back upon themselves to form a three layer section. To complete the fabrication, the base portion is folded toward the folded elongated tabs such that the short tabs are positioned adjacent at least one elongated tab to form a second section of two layers.

17 Claims, 4 Drawing Sheets

MULTI-LAYERED SHINGLE

FIELD OF THE INVENTION

The present invention is directed to the field of roofing shingles, more particularly to a multi-layered shingle that when laid in an array of plural courses will have the appearance of a wood shingle roof.

BACKGROUND OF THE INVENTION

The present invention relates to a unique shingle covering, such as for application to a roof, that includes multiple layers, such as a triple thick and double thick sections. Single ply shingles, where a conventional material be asphalt, and the like, have been a staple of the residential construction business for a number of years, where a typical roof may comprise a plywood paneled base covered by a tar paper, usually provided in a continuous roll, followed by the application of plural courses of shingles in overlapping relationship. Such a practice is quite widespread as it provides an effective water seal to the structure, and it is generally economical, i.e., an efficient roofing system. Later, other roof covering systems were developed, such as wood, and slate, which gave to the structure a new and different appearance. The development of these alternate systems spurred the roofing industry to modify the traditional roofing shingles to give them the appearance of wood shingles, and to avoid objectionable repetition patterns. U.S. Pat. No. 4,499,702 represents an attempt to improve the appearance of a shingle. Such patent is directed to a five-tab strip shingle having a base with rectangular tabs of varying widths and lengths extending from the base. When conventionally placed on a roof structure, the different courses avoid objectionable repeating patterns. U.S. Pat. No. 5,375,387 is another roofing shingle that is intended to simulate a slate roof covering by the use of plural tabs with different widths and lengths.

Recognizing the commercial need to improve the appearance of shingle like roof coverings, especially as to simulating a different kind of shingle, the prior art developed multi-layered shingles. Such prior art is reflected in the following U.S. Patents:

a) U.S. Pat. No. 3,624,975 which teaches an asphalt strip shingle intended to simulate the irregularity and attendant shadow effects or material variations in dimensions found in wood shingles. The strip shingle comprises a laminate consisting of a first or base lamina, and a second or apron overlay lamina, where the latter consists of male and female strips. The base lamina is essentially rectangular in shape, whereas the respective overlay lamina feature a base with plural, downwardly extending tabs whose side edges are combinations of perpendicular and non-perpendicular to the base. When laminated to the base lamina, certain of such tabs extend below the lower edge of the base lamina. Further, when the laminated shingle is secured in overlapping relationship, as with conventional shingles, an irregular simulated wood shingle results.

b) U.S. Pat. No. 4,233,100 is directed to a shingle making machine to form a shingle from two shingle members, where the machine takes a continuous web of shingle material and cuts the web to define a series of sets of shingle members. The shingle members comprise a base with plural tabs extending there from. The cut shingle members are then conveyed to a laminating station, where they are laminated to an underlay to form a laminated shingle.

c) U.S. Pat. No. 4,717,614 relates to a composite shingle comprising a first portion having a base with plural tabs extending there from, and a second continuous, narrowed portion secured to and underlying the respective tabs. By this arrangement, in section, the tabs are thicker than the base.

d) U.S. Pat. No. 4,869,942 teaches a three level shingle formed of bituminous coated glass mats. More precisely, the resulting shingle includes a single base layer and two levels or layers for the tabs extending from the base.

e) U.S. Pat. No. 5,860,263 is directed to a thickened reinforced roofing shingle that is described as a rectangular, shingle having front and rear stepped edges and an undivided headlap portion and a butt portion horizontally divided into dissimilarly shaped, space-separated, snaggle toothed tabs integral with, and extend from the bottom portion of said headlap and which are recessed from the side edges of said headlap.

f) U.S. Pat. No. 5,052,162 is essentially identical to the trilaminated roofing shingle of U.S. Pat. No. 4,869,942, except it does not glue on a backer strip for a triple thickness look. The backer strip is inverted and glued, then cut to produce a laminate having cut-out areas between the remaining tabs. It is the object of the present invention to provide an apparatus for making a laminated roofing shingle in a continuous operation.

The foregoing inventions, while offering a multi-layered shingle to enhance the appearance of a roof, do not present a convenient way to provide a multi-layered shingle that features a cross section for a unitary shingle having three layers adjacent two layers. The manner by which the present invention achieves this unique construction, and hence a different shingled roof for the building industry, will become clearer in the following specification, particularly when read in conjunction with the accompanying drawings.

SUMMARY OF THE INVENTION

The present invention relates to an asphalt, or similar type of material, shingle roof covering which when applied to a roof will have the appearance of a wood shingle roof. The final shingle is made from a single planar mat, then folded and/or processed into a triple thick shingle. The planar mat comprises a body portion defined by first and second lateral edges, plural elongated tabs of different widths extending from the first lateral edge, and plural stub tabs transversely offset from and extending from the second lateral edge. For the operational or placement mode for the shingle, the elongated tabs are double folded, along a precut or score line, with a first fold being 180 degrees at the first lateral edge, followed by a reverse bend of 180 degrees back upon itself. A second major bend occurs laterally through the body portion towards the folded tabs, where each stub tab is arranged to lie in a space between the folded tabs. This results in a shingle having a 3-layer portion and a 2-layer portion, with a tapered or thick dimensional look on top of a backer strip, i.e., body portion.

Accordingly, an object of the present invention is the provision of a multi-layered shingle that when placed in an array of courses along a roof simulates the appearance of a wood shingle roof.

Another object of the invention is a one-piece shingle that has no backer strip that may fall off if not nailed properly.

A further object hereof is a shingle having a triple thick overlay and a double thick headlap portion.

These and other objects of the invention will become more apparent in the description which follows.

BRIEF DESCRIPTION OF DRAWINGS

The invention is illustrated in the drawings in which like reference characters designate the same or similar parts throughout the Figures of which.

DETAILED DESCRIPTION OF PREFERRED EMBODIMENT

The invention, as illustrated in the several Figures, relates to a multi-layered shingle, preferably formed of blown asphalt with filler agents, fiberglass base mat and roofing granules (ceramic stone). However the shingle, may be fabricated with or of other roofing materials, as known in the art, such as organic paper based asphalt saturated and coated material, rubberized material, metal, slate, and with a thermoplastic additive, such as but not limited to styrene butadiene styrene (SBS) copolymer. The latter type of roofing material is particularly desirable as it creates an unrivaled nail seal ability and flexibility. Modified bitumens roof systems are typically categorized into two basic polymer groups: SBS (styrene-butadiene-styrene), an elastic type of modified bitumen; and APP (atactic polypropylene), a plastic type of modified bitumen which could be utilized in high temperature climates for stability and flexibility. Modified bitumen membranes are composed of three primary elements: asphalt flux, polymer modifiers, and reinforcements. Secondary elements are fillers, fire-retardant additives and surfacing. The rubber- or plastic-based modifiers extend the performance capabilities of asphaltic materials. Properly modified compounds exhibit increased resistance to aging and improved mechanical properties at both high and low temperatures. Reinforcements commonly used in the U.S. are polyester and fiberglass, which are available in a variety of types and weights. Some manufactures offer products which have a reinforcement composite of a polyester/fiberglass laminate. A scrim web fabric could also be embedded in the asphalt to reinforce the slits and folded areas. New reinforcement combining the best properties of glass fiber and polyester fabric to provide superior flexibility, strength, puncture resistance and dimensional stability, could replace the standard fiberglass base mats used today.

Figure 1:
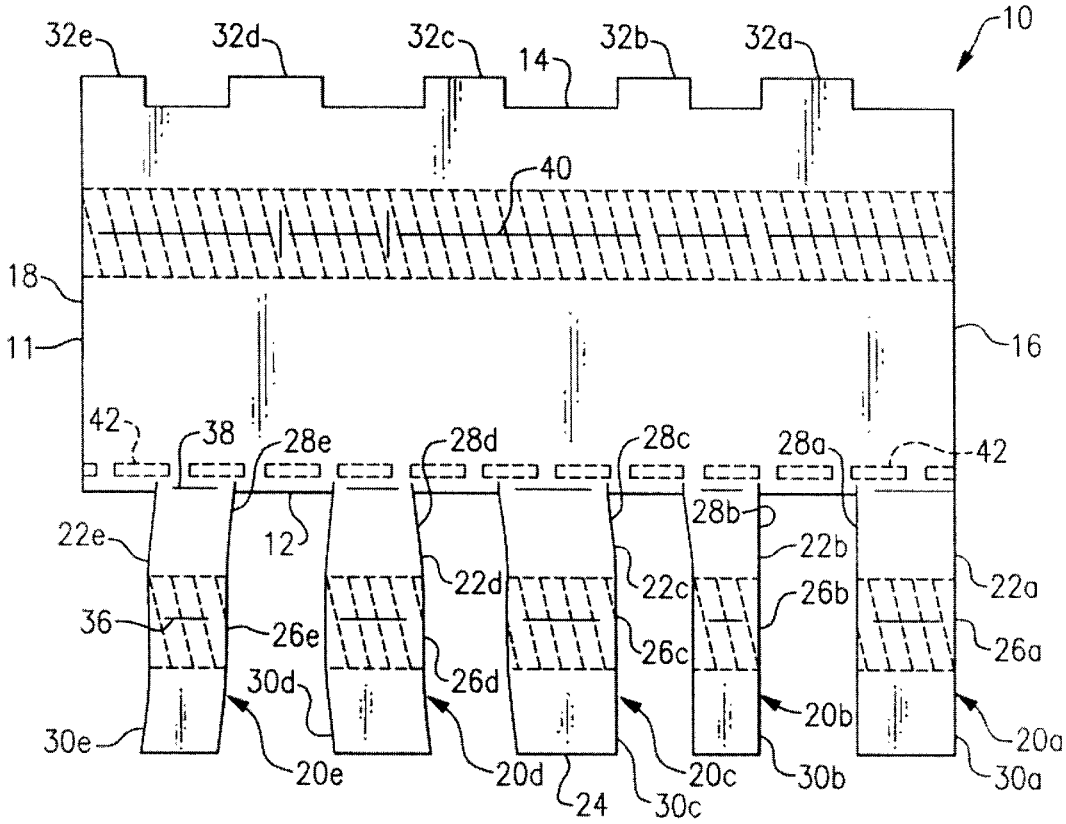
FIG. 1 is a top view of a single, unfolded shingle according to a preferred embodiment of the present invention, where the shingle shows a base portion having a pair of lateral edges, plural tabs extending from one of the edges and plural stub tabs extending from the opposite lateral edge.

FIG. 1 illustrates the starting shingle product of a preferred embodiment of the present invention in the form of a planar sheet 10, formed of a roofing material, where an exemplary material is asphalt. However, it will be understood that the invention hereof is applicable to other roofing materials, such as noted above, and that reference later to asphalt is for the sole purpose of understanding the invention. The planar sheet 10 comprises a base portion 11 having upper and lower surfaces, first and second, parallel lateral edges 12, 14, respectively, and a pair of side edges 16, 18. Extending from the said first lateral edge 12 are plural, spaced apart, elongated tabs 20*a*, 20*b*, 20*c*, 20*d*, and 20*e*, where each said tab is characterized by a pair of side edges 22*a*, 22*b*, 22*c*, 22*d*, and 22*e*, respectively, and a bottom edge 24. It will be noted that the respective elongated tabs are distinctly shaped, such as from the rectangle of tab 20*a* to the S-shape of tab 20*d*. Notwithstanding the distinct differences, the respective elongated tabs have some features in common, namely a height, and three separate sections, where the respective midsections 26*a*, 26*b*, 26*c*, 26*d*, and 26*e* each include side edges which are perpendicular to the first lateral edge 12. The inner and outer elongated tab sections 28*a*, 28*b*, 28*c*, 28*d*, and 28*e*, and 30*a*, 30*b*, 30*c*, 30*d*, and 30*e*, respectively, feature side edges where one or both said edges are angled to said first lateral edge 12, see FIG. 1. Note also that the outer side edge 22*a* of elongated tab 20*a* is coextensive with the side edge 16. Though not illustrated, the bottom edge 24 of the respective elongated tabs may be scalloped, such as a sinusoidal curve, to simulate tile roofs.

Extending planarly from the second lateral edge 14 are a like plurality of short tabs 32*a*, 32*b*, 32*c*, 32*d*, and 32*e*, where said short tabs are laterally offset from the positions of the elongated tabs. Note that the side edge 30*a* is coextensive to side edge 16 of said base portion 11, see FIG. 1. As will be described later with regard to the folded and operable shingle, the arrangement of the short tabs is such that when folded toward the elongated tabs they will lie in the gaps aside or between the elongated tabs.

To facilitate folding of the elongated tabs and base portion 11, especially because of the traditional thickness of roofing material, a series of slots 36, 38, and 40 are provided, or in the alternative, the shingle may be provided with scored lines, embossed lines or folded by forming rolls when run in-line. In any case, the slots 36 are short of the side edges and within the respective midsections 26*a*, 26*b*, 26*c*, 26*d*, and 26*e*. The slots 38 are positioned to allow folding of the elongated tabs generally along the first lateral edge 12. The final slots 40 are a series of laterally aligned slots to allow folding of the base portion 11 upon itself, as later detailed. Further, to help in the application of the shingles to a roof structure, alignment slits 41 may be included for spacing and located perpendicular to the aligned slots 40.

The planar sheet 10 further features plural sealing strips 42, on the back side surface of the sheet, in proximity to the slots 38. Additionally, also on the back side surface of the sheet, are two areas (shown in dotted lines in FIG. 1) of a release film, as known in the art, to coincide with the aligned slots 40 and the respective midsections 26*a*, 26*b*, 26*c*, 26*d*, and 26*e*. In a preferred embodiment, the planar sheet 11, dimensionally, is 40 inches by 30¼ inches, tab end to tab end, and 11½ inches for the height of the elongated tabs. Further, in the unique shape of the planar sheet of FIG. 1, the first lateral edge 12, from right to left, would measure 4½ inches or base of elongated tab 20*a*, 4½ inches space, 3⅜ inches for base of elongated tab 20*b*, 3½ inches space, 5 inches for base of elongated tab 20*c*, 4 inches space, 3¾ inches for base of elongated tab 20*d*, 4½ inches space, 3½ inches for base of elongated tab 20*e*, and 3⅜ inches to end.

Figure 2:
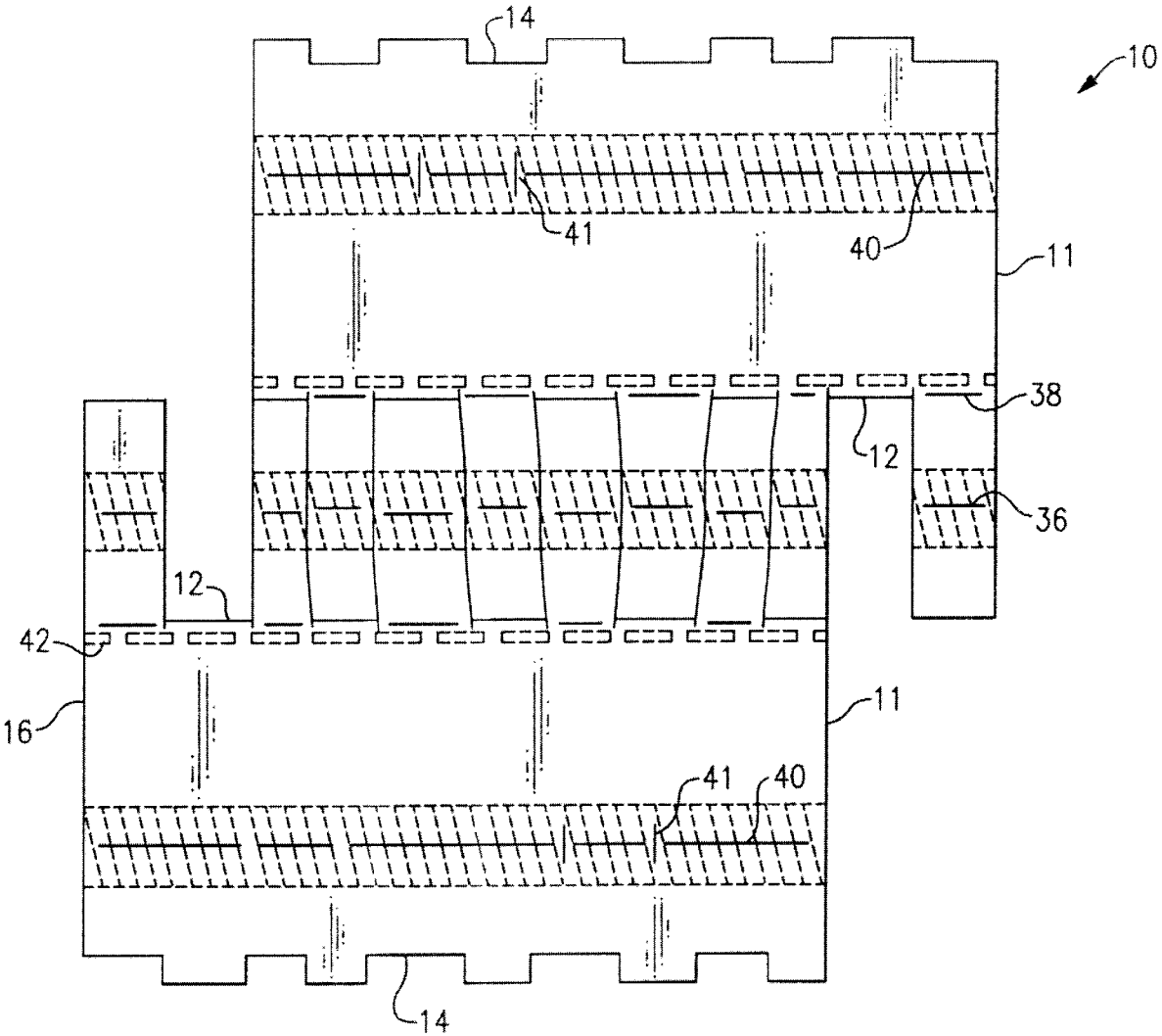
FIG. 2 is a top view of a pair interlocking shingles as they may be stamped, machine die rolled or hand cut from a continuous web of shingle material.
Figure 3:
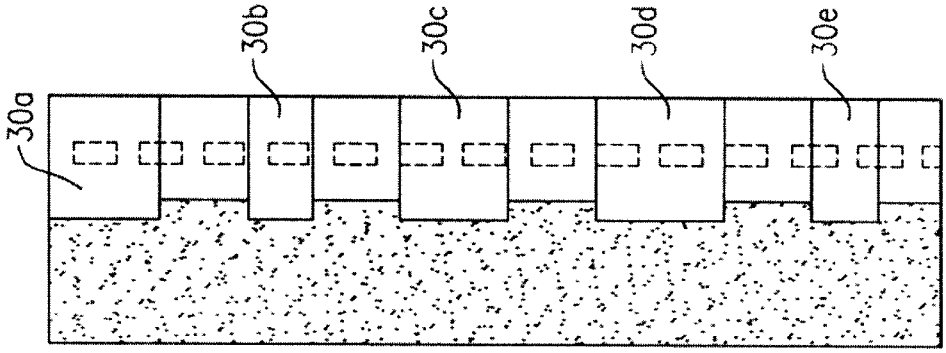
FIG. 3 is a top view of the shingle of FIG. 1 in a folded roof placing mode according to the present invention.

FIG. 2 illustrates a convenient means of stamping and fabricating plural planar sheets 10 from a continuous web of roofing material, such as asphalt. Note that the respective elongated tabs interfit and are longitudinally offset to minimize product waste. The only waste will be nominal from stamping out the various short tabs 32*a*, 32*b*, 32*c*, 32*d*, and 32*e*.

Figure 4:
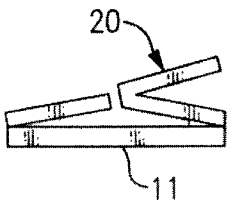
FIG. 4 is an end view showing a partially folded shingle of the invention.

Turning now to the fabrication of the shingle, utilizing FIGS. 1, 3, 4, and 5, the elongated tabs are individually or jointly bent, i.e., 180 degrees along the slots 38, onto the upper surface of the base portion 11, then reversely bent 180 degrees back onto themselves along slot 36, see the pre-final fold in FIG. 4. The final fold is the base portion along slots 40 onto the upper surface of the base portion 11, whereby the several short tabs nestle between or along side of the respective folded, elongated tabs, see FIGS. 3 and 5, where the latter Fig. is a top perspective view of the shingle of the present invention as it may be placed upon a roof structure. As a roofing shingle, the shingle hereof offers double protection of the underlying roof by having additional layers of material in both the exposed side and the unexposed head lap portion. Additionally, it offers an increase in fire-rating protection due to the added surface material. Finally, the shingle provides a heavier finish weight which means an increasing wind blow off characteristic.

For the roofer the shingle of the present invention is easy to apply. The shingle may be mass applied and not affect the overall appearance of the finished roof. For example, with competitive products, it is often necessary to add black granules to the surface to simulate a shadow line effect. When the applicator moves the shingles down to realign the shingles, the shadow line disappears leaving a blotch roof appearance. In contrast, with the shingle hereof being thicker, it has a natural shadow and will not disappear at less than standard exposures or misalignment.

Figure 6:
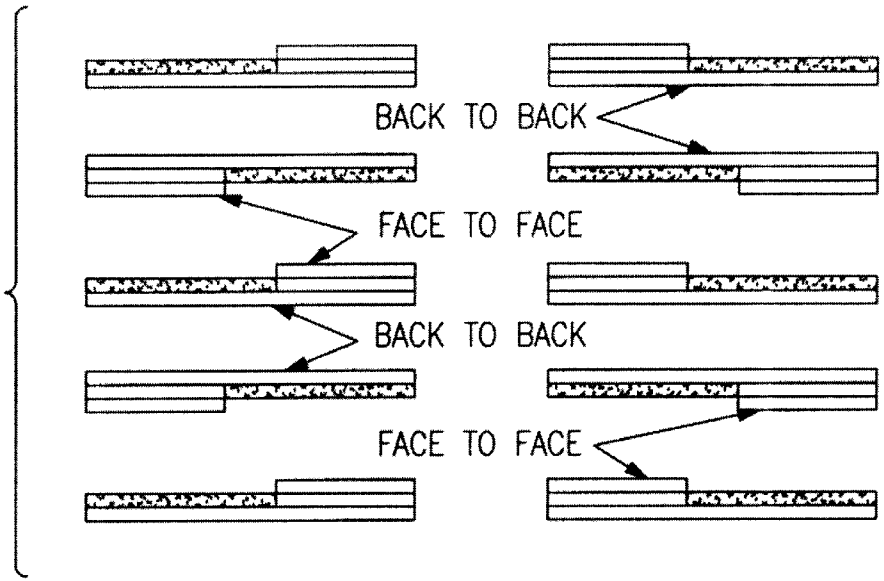
FIG. 6 is a sequence of end views showing a recommended packaging arrangement.
Figure 7:
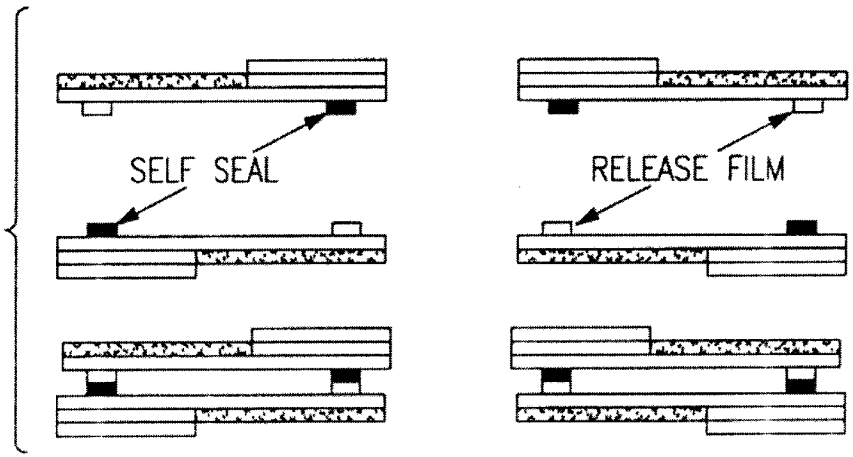
FIG. 7 is a sequence of ends views, similar to FIG. 6, illustrating self sealing and release film locations.
Figure 5:
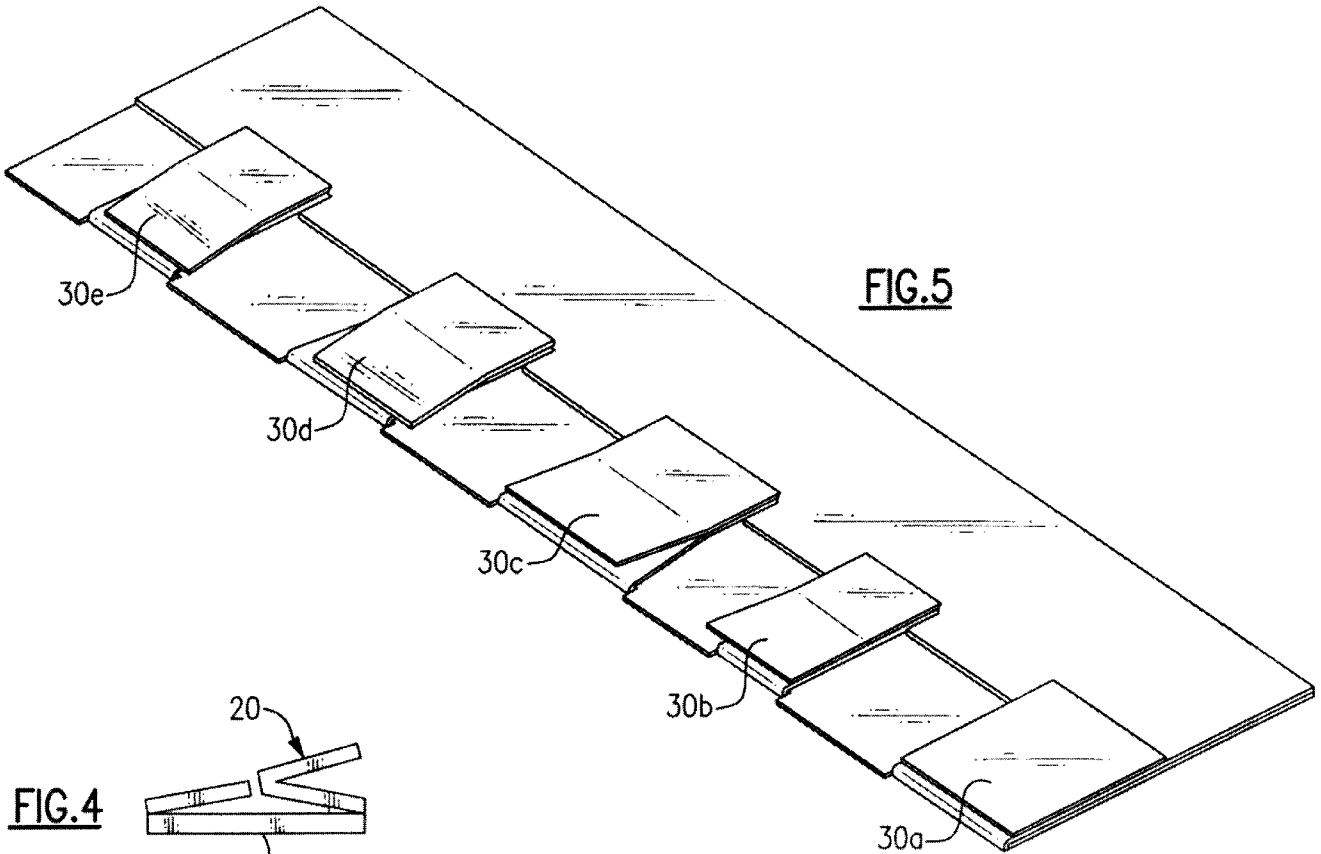
FIG. 5 is a top perspective view of the folded shingle of FIG. 3.

Since packaging and handling is important to ensure a viable roofing product, FIGS. 6 and 7 illustrate a convenient way for packaging plural shingles into a single package. The self seal and release film, applied to the lower surface of the shingle, the purpose of which are known in the art, are shown exaggerated in thickness. In any case, to package a plurality of shingles into a single package, the respective shingles are positioned face-to-face, then back-to-back, then repeated, as illustrated in FIG. 6, until a convenient quantity of shingle may be suitably packaged and handled.

It is recognized that changes, variations and modifications may be made to the shingle of the present invention, or to the method of fabricating same, particularly by those skilled in the art, without departing from the spirit and scope of the invention. Accordingly, no limitation is intended to be imposed on the invention except as set forth in the appended claims. All patents, publications and other documents referred to herein are incorporated by reference in their entirety.

What is claimed is:

1. An integral, one-piece, multi-layered shingle fabricated from a planar sheet of shingle material, said planar sheet comprising a base portion having first and second, parallel, lateral edges, plural elongated tabs extending from said first lateral edge, said elongated tabs comprising a pair of side edges and a top edge, where said side edges have at least a portion perpendicular to said first lateral edge, and plural stub tabs extending from said second lateral edge, where said stub tabs are laterally displaced with regard to said elongated tabs, said elongated tabs being first folded upon said base portion, then each reversely folded back upon itself at a midpoint to present a first multi-layered thickness, and said base portion folded upon itself, whereby each said stub tab is positioned adjacent at least one said elongated tab to present a second multi-layered thickness adjacent said first multi-layered thickness.

2. The integral, one-piece, multi-layered shingle of claim 1, wherein said elongated tabs and said base portion include lateral fold facilitating means.

3. The integral, one-piece, multi-layered shingle of claim 2, wherein said fold facilitating means comprises a slit in the sheet of shingle material.

4. The integral, one-piece, multi-layered shingle of claim 1, wherein said elongated tabs are each differently shaped, where a first said elongated tab has side edges perpendicular to said first lateral edge, and the remaining said elongated tabs have side edge portions angled to said first lateral edge.

5. The integral, one-piece, multi-layered shingle of claim 1, wherein base portion includes sealing areas to maintain the integrity of said shingle in said folded state.

6. The integral, one-piece, multi-layered shingle of claim 1, wherein said side edges of said elongated tabs extend into said base portion.

7. The integral, one-piece, multi-layered shingle of claim 1, wherein said shingle includes a release film about the areas of folding said elongated tabs and said base portion, where said release film, when folded, allows for a tapered appearance.

8. A method of fabricating an integral, multi-layered shingle from a planar sheet of shingle material, said method comprising the steps of:

a) selecting a planar sheet of shingle material, where said planar sheet comprises a base portion having first and second, parallel, lateral edges, plural elongated tabs extending from said first lateral edge, said elongated tabs comprising a pair of side edges and a top edge, where said side edges have at least a portion perpendicular to said first lateral edge, and plural stub tabs extending from said second lateral edge, where said stub tabs are laterally displaced along said second lateral edge such that each said stub tab may lie adjacent at least one of said elongated tabs;

b) folding each said elongated tab onto said base portion generally along said first lateral edge;

c) reverse folding each said elongated tab upon itself generally along a midpoint thereof; and, d) folding said base portion upon itself, whereby each said stub tab is positioned adjacent at least one of said elongated tabs, whereby to provide a shingle having a pair of multi-layered sections.

9. The method of claim 8, wherein said planar sheet is preslotted to facilitate said folding of said elongated and said base portion.

10. The method of claim 8, wherein said elongated tabs are distinctly different from one another.

11. An integral, one-piece, multi-layered shingle fabricated from a planar sheet of shingle material, said planar sheet comprising a generally rectangular base portion having first and second, parallel, lateral edges and parallel side edges, plural elongated tabs extending from said first lateral edge, said elongated tabs comprising a pair of side edges and a top edge, and plural short tabs extending from said second lateral edge, where said short tabs are laterally offset with regard to said elongated tabs, where a first side edge of one elongated tab is an extension of a first side edge of said base portion, and a second side edge of one short tab is an extension of a second side edge of said base portion, said elongated tabs being first folded upon said base portion, then each reversely folded back upon itself at a midpoint to present a three layer thickness, and said base portion folded upon itself from said second lateral edge, whereby each short tab is positioned adjacent at least one said elongated tab to present a two layer thickness adjacent said three layer thickness.

12. The integral, one-piece, multi-layered shingle of claim 11, wherein said elongated tabs and said base portion are slotted to facilitate folding.

13. The integral, one-piece, multi-layered shingle of claim 11, wherein said shingle material is asphalt.

14. The integral, one-piece, multi-layered shingle of claim 11, wherein said shingle material is a styrene butadiene copolymer having a thermoplastic rubber additive.

15. The integral, one-piece, multi-layered shingle of claim 11, including along said base portion sealing means to maintain the integrity of said shingle in said folded state.

16. The integral, one-piece, multi-layered shingle of claim 11, wherein said side edges of said elongated tabs extend into said base portion.

17. The integral, one-piece, multi-layered shingle of claim 11, wherein said shingle includes a release film about the areas of folding said elongated tabs and said base portion.

* * * * *

UNITED STATES PATENT AND TRADEMARK OFFICE

CERTIFICATE OF CORRECTION

PATENT NO. : 6,510,664 B2
DATED : January 28, 2003
INVENTOR(S) : Kupczyk

It is certified that error appears in the above-identified patent and that said Letters Patent is hereby corrected as shown below:

Title page,
Item [76], Inventors, add inventor -- Lawrence Penner --

Signed and Sealed this

Twenty-fifth Day of May, 2004

JON W. DUDAS
*Acting Director of the United States Patent and Trademark Office*